US008631742B2

(12) United States Patent
Spiesshofer

(10) Patent No.: US 8,631,742 B2
(45) Date of Patent: Jan. 21, 2014

(54) METHOD FOR OPERATING PRESSES

(75) Inventor: Thomas Spiesshofer, Bermatingnen (DE)

(73) Assignee: Mueller Weingarten AG, Weingarten (DE)

( * ) Notice: Subject to any disclaimer, the term of this patent is extended or adjusted under 35 U.S.C. 154(b) by 6 days.

(21) Appl. No.: 13/502,897

(22) PCT Filed: Oct. 19, 2010

(86) PCT No.: PCT/DE2010/001208
§ 371 (c)(1),
(2), (4) Date: Apr. 19, 2012

(87) PCT Pub. No.: WO2011/047661
PCT Pub. Date: Apr. 28, 2011

(65) Prior Publication Data

US 2012/0210887 A1 Aug. 23, 2012

(30) Foreign Application Priority Data

Oct. 22, 2009 (DE) ..... 10 2009 050 390

(51) Int. Cl.
*B30B 15/14* (2006.01)

(52) U.S. Cl.
USPC ..... 100/35; 100/49; 100/207

(58) Field of Classification Search
USPC ..... 100/35, 43, 48, 207; 83/527, 530, 613, 83/615–616, 617, 627, 639.1; 72/20.1, 72/20.2, 20.4, 20.5, 21.4, 21.6, 31.01, 443
See application file for complete search history.

(56) References Cited

U.S. PATENT DOCUMENTS

| | | | | |
|---|---|---|---|---|
| 6,237,479 | B1 * | 5/2001 | Douba | 100/43 |
| 2004/0003729 | A1 * | 1/2004 | Aoshima | 100/35 |
| 2008/0109105 | A1 | 5/2008 | Weber et al. | |
| 2009/0007622 | A1 | 1/2009 | Golorons et al. | |
| 2011/0132209 | A1 * | 6/2011 | Senda et al. | 100/35 |
| 2012/0111207 | A1 * | 5/2012 | Kuboe | 100/35 |

FOREIGN PATENT DOCUMENTS

| | | |
|---|---|---|
| DE | 35 30 823 | 3/1986 |
| DE | 196 42 962 | 4/1998 |
| DE | 10 2004 030 678 | 1/2006 |
| DE | 10 2004 015 739 | 4/2006 |
| DE | 10 2005 024 822 | 11/2006 |
| DE | 10 2005 040 762 | 3/2007 |
| DE | 10 2007 026 727 | 12/2007 |
| DE | 10 2007 003 335 | 7/2008 |
| DE | 10 2007 024 024 | 11/2008 |
| DE | 10 2007 026 227 | 12/2008 |
| DE | 10 2008 064 229 | 7/2010 |
| EP | 1 880 837 | 1/2008 |
| EP | 2 177 346 | 4/2010 |

* cited by examiner

*Primary Examiner* — Dana Ross
*Assistant Examiner* — Leonel Vasquez
(74) *Attorney, Agent, or Firm* — Jordan and Hamburg LLP

(57) ABSTRACT

In a working method using a device for operating presses including a ram and a die, such as forming presses or cutting presses, for example multiple-die presses for large work-pieces, transfer presses, multi-ram transfer presses, such forming presses or cutting presses also being arranged in press lines, smaller ram strokes result in optimized freedom of motion of the press, in place of the existing large freedom of motion, the acceleration and speed of the ram are at most maintained, or reduced, while parts output is increased, and smaller paths are made possible due to dynamic ram stroke and transfer movements. To this end, the work process of the ram stroke of presses is controlled according to a curve that follows the function f(x)=a(0)/2+a(1)*cos(1*x) +...+.

14 Claims, 7 Drawing Sheets

METHOD FOR OPERATING PRESSES

BACKGROUND OF THE INVENTION

The invention relates to a method for operating presses comprising a ram and a die, such as forming processes or cutting presses, for example multiple-die presses for large workpieces, transfer presses, multi-ram transfer presses, such forming presses or cutting presses also being arranged in press lines.

Such forming presses, press lines or cutting presses essentially comprise the work steps of feeding, optionally centering, forming or cutting, and depositing the parts, with integrated transfer steps for the parts. In general, means for a transfer system are provided for transporting the parts that are formed or to be formed, or cut or to be cut, optionally via a centering system. The cooperation of these steps and systems is matched to the cycled forming strokes, or cutting strokes, of the respective forming press or cutting press. Both the cycled operating mode to be maintained, and notably the superposition of movement processes for pressing and transferring the parts to be worked, require spacing resulting in a so-called freedom of motion of the press. This necessary freedom of motion is an essential criterion for the design or configuration of presses of the type mentioned above in terms of kinematics and construction.

Given the complexity of the processes and systems of these types of presses, they are subject to increased market demands in terms of cost reductions for the press itself, and the drive trains thereof, as well as peripheral devices, and increases in the performance thereof.

It is now obvious to analyze forming presses or cutting presses, and peripheral systems, in terms of the required dimensions thereof, so as to lower costs by optimizing:

construction by way of material savings; and process flows.

Any increase in the performance of the drive trains, which is also required so as to boost the output of the press, in turn typically requires higher costs.

The implementation of the desired large strokes, and hence large presses, as well as powerful drives, is in contrast with necessary cost reductions, although the demand for cost reductions on the part of the market is urgent.

Considerations intended to create solutions that are less expensive or optimized in terms of output must generally abide by press technology rules, which are primarily as follows:

The overall system, as described above, is subject to physical limits, which are defined by technical functions such as avoiding collisions of the involved transfer means, dies and workpieces, forming forces and forming speeds, and accelerations and speeds, and the temporal change thereof, while transporting parts between the forming stages.

The diversity of shapes, and more particularly the three-dimensional shapes of the parts, such as workpieces, the transfer thereof and the dies involved call for a high freedom of motion of the presses, as addressed above, which is typically achieved with relatively large stroke lengths of the press rams, and press frames and drive trains that are designed accordingly, in turn, result in high costs.

So as to achieve a balanced relationship between this freedom of motion and stroke lengths, advantageous transfer means, such as so-called crossbar feeders and/or swing arms, are already used according to an internal state of the art.

The principle of the two systems involves moving a crossbar over the part to be transported so as to then hold the part itself over a vacuum suction pad attached to the crossbar during transport. The transfer units differ only with respect to the drive kinematics.

Based on the special kinematic processes for transporting the parts, such as workpieces, from one work step to another, and the pivoting thereof during the transport process, including the deformation or cutting operation, alone, these systems can be used to achieve optimized stroke lengths for the presses.

The progression of a press ram in the form of a diagram tracked by a person skilled in the art during such press processes is shown, for example, in the curve according to FIG. 1, with respect to the understanding of the prior art. The curve approximately follows a progression according to $f(x)=\sin x$. In theory, a ram stroke of 1590 mm, a line stroke rate of 16 strokes/minute, and a forming speed of 600 mm/s at 200 mm before the lower reversal point (UU) are assumed. In practice, ram strokes up to approximately 1400 mm were carried out, with the corresponding drawbacks.

This progression of the ram curve is typical of presently known presses of the type mentioned above, which is shown, amongst other things, by the documented prior art.

The advanced prior art in question has always observed the physical rules set forth above.

The presses developed based thereon, and the processes thereof, do not reveal any potential, without further action, for solving the complex problem of how to:

further increase the output of presses on the one hand; and lower the height, material use and costs on the other hand.

The analysis of the prior art provided below shows only isolated improvements in this regard.

According to DE 10 2004 015 739 B4, the stated problem was already that of providing a dedicated transfer device for each of the consecutively arranged forming stages of a multi-ram transfer press, in which the orientation stations can be eliminated, and which is suitable for retrofitting older multi-ram transfer presses. To this end, the vertical movements of the crossbars of the carriages, which are arranged in pairs, are directed by a swing arm, such that the size of a pivot angle can be adjusted via a drive and a gear and bearing means.

According to DE 10 2004 030 678, the object was to achieve the most compact shape possible, so as to reduce the complexity of control of a metal-working press. However, the solution focused on the function of the associated die cushion. The pressure application that is regulated only has a marginal effect in terms of compact design for the overall press.

A review of DE 10 2005 024 822 A1 shows that this document was already directed to a simulation method for transfer presses, whereby workpiece output can be optimized, while avoiding collisions. While the simulation program associated with the press controller achieves advantageous workpiece output and allows collision-free patterns of movement, after previously calculating collision risks, the heretofore customary heights of the presses must be maintained.

Moreover, in a production line such as a press line in accordance with DE 2005 040 762, operation-related deviations of the main working directions must take place without impairment.

The work processes are coordinated with a master computer, by meaningfully linking workpiece working devices and workpiece transporting devices. Although there is positive effect in terms of optimized workpiece output, the customary heights of the presses still remain.

The problem stated in DE 10 2007 003 335 A1 was that of facilitating the programming of drive units for presses which comprise one or more servo motors and a ram, which are connected to a coupling gear. The coupling gear was provided with ratio characteristics which, in the vicinity of the bottom dead center of the ram, exhibit high dynamic rigidity. The program captures representations of the resulting movements of the ram so as to intervene in a controlling manner.

In a drive device for a multi-ram transfer press according to DE 10 2007 024 024 A1, both high pressing forces and variable ram movements are to be implemented using at least one primary drive and at least one secondary drive.

The relatively high complexity of the entire drive device for transmitting the driving energy to all stages of the multi-ram transfer press, or to all individual presses of the press line, offers no suggestions in terms of finding implementation options for reduced height.

Finally, even with a multi-point forming press for ram movement in accordance with 10 2007 026 227 A1, high pressing forces were to be implemented with the available torque of servo motors, in addition to which the driving expenditure was to be lowered using several mechanically synchronized pressure points, so as to obtain, amongst other things, a favorable spatial tilt design in two planes. The combination of crank wheels, intermediate wheels and pinion shafts, in the framework of a gear-reducing unit, which was provided as the solution, does not offer any advantages in terms of decreased height or optimized workpiece output.

Thus, after critical analytical review of the examined solutions and the rules applied, further approaches must be found for distinguishing these with respect to a new stated technical problem relating to demand for cost reduction.

SUMMARY OF THE INVENTION

Problem

The object of the invention is to change the work process of the work steps and the means for operating forming presses, or cutting presses, of the type described above, while observing established physical boundaries, and physical boundaries to be newly established, such as the avoidance of collisions with the transfer means, dies and workpieces involved, and the forming forces and the forming speeds, while observing a minimum required ram stroke height, such that:

- smaller ram strokes result in an optimized freedom of motion, rather than the existing large freedom of motion;
- acceleration and speed of the ram are, at most maintained, or reduced, while parts output is increased; and
- smaller paths are made possible by way of dynamic ram stroke and transfer movements.

This stated problem is based, on one hand, on the consideration that it is not the action of a large or small ram stroke on the workpiece to be formed or cut, but the forming speed, which is decisive. On the other hand, the freedom of motion was considered and an attempt was made to preserve the freedom of motion, even with reduced ram strokes, which is to say, to depart from the previously unalterable rule that a large, or desirable, freedom of motion of the presses necessitates large stroke lengths of the press rams. For this purpose, any parameters that influence output, and partially conflict with output must be reviewed, considered and matched to each other. The essential parameters are: forming speed, freedom of motion, part acceleration and speed, and the gradients thereof.

Surprisingly, it was found that the object is achieved, in terms of the method of claim 1, by way of open loop or closed loop control of the work process of the ram stroke in presses, in accordance with a curve shown in the diagram below in FIG. 2, in which, compared to the diagram shown above, a relatively small ram stroke of 1000 mm, cycled at a press stroke rate of 24.7/ minute, is specified.

The surprising difference over the prior art, which is relevant to the invention, is illustrated by a comparison of the diagrams of the ram curves according to FIG. 3.

According to the invention, a working method is thus provided for operating forming presses or cutting presses such as multiple-die presses for large workpieces, transfer presses, multi-ram transfer presses, such forming presses or cutting presses also being arranged in press lines, comprising the work steps of feeding, optionally centering, forming or cutting, and arrangement of the parts, with integrated transfer steps for the parts, for which purpose means for a transfer system are provided for transporting the parts that are formed or to be formed, or cut or to be cut, optionally via a centering system, corresponding the cycled forming strokes or cutting strokes to the respective forming press or cutting press, in which the work process of the ram stroke is controlled in accordance with the function f(x) =a(0)/2+a(1)*cos(1*x)) + a(2)*cos(2*x) + ... +a(n)*cos(n*x) +b(1)*sin(1*x) +b(2)*sin(2*x) +.. +b(n)*sin(n*x), while actively influencing at least one of the values of a stroke rate of the ram (2),
position of the ram (2) defined in terms of time or path,
driving force of the ram (2),
speed or acceleration of the ram (2),
minimum freedom of motion of the press (1) or
transfer movement from one press (1) to another press (1).

The working method can be expanded if values for the stroke of the ram are specified in a cycled manner relative to a press stroke rate that is increased by >1, for example by 1.5, and moreover at least one value, such as a first "position" of the process of the stroke over time, is monitored. Here, a denotes the stroke and x denotes values from 0 to 2*Pi.

For the purposes of the invention, a specified variable is thus taken as a value which is also used for closed-loop or open-loop control during the work process of the ram stroke in sub-regions, so as to specify a relatively small ram stroke, in a cycled manner, for the press stroke rate, so as to achieve optimized and sufficient freedom of motion, instead of the existing large, oversized freedom of motion of the press.

Any cyclical movement of the stroke is thus represented and specified by the following formula:

$$\text{Stroke}=a(0)/2+a(1)*\cos(1*x)+a(2)*\cos(2*x)+\ldots+b(1)*\sin(1*x)+b(2)*\sin(2*x)+\ldots$$

To this end, x can range from 0 to 2*Pi.

The accuracy can be determined and adjusted using a number of coefficients which are functionally defined below.

In a further embodiment of the working method, the progression of the start and end of the stroke ram is monitored, open loop controlled, and optionally closed loop controlled, so as to exactly maintain a time dependent or rotational angle dependent tracked position of the ram in a reproducible manner.

The progression of the run-out of the ram stroke is thus also monitored, and values are measured, such as a first "position" as the position for driving force from the ram and a second "position" as the position for separating the driving force from the ram.

To this end, both the progression of the start of the stroke within a first path and the progression of the run-out of the stroke within a second path can be monitored, measured, and then controlled.

The working method can be expanded into a functionally merged combination of work steps if:

in a general step, the work process of the ram stroke is specified and controlled in accordance with the function $f(x)=a(0)/2+a(1)*\cos(1*x))+a(2)*\cos(2*x)+\ldots+a(n)*\cos(n*x)+b(1)*\sin(1*x)+b(2)*\sin(2*x)+\ldots+b(n)*\sin(n*x)$;

in an integrated further step, the progression of the start of the ram stroke is monitored and the first "position" of the full driving force transmission to the ram is measured, and optionally controlled by closed loop; and in an integrated third step, the progression of the run-out of the ram stroke is monitored and the second "position" of the separation of the driving force from the ram is measured, controlled by open loop, and optionally controlled by closed loop.

According to the method, any cyclical movement of the ram can thus be controlled according to the formula $\text{Stroke}=a(0)/2+a(1)*\cos(1*x)+a(2)*\cos(2*x)+\ldots+b(1)*\sin(1*x)+\ldots+b(2)*\sin(2*x)+\ldots+$ and coefficients found based thereon.

The press is advantageously operated according to a program which comprises the aforementioned steps for automatically controlling the press, wherein the program comprises data that can be adjusted, or which are to be achieved for these steps, such as the speed and acceleration of the ram and a minimum freedom of motion of the press.

The program, which comprises the aforementioned steps for automatically controlling the press 1, should comprise at least one of the program steps, such as:

values found according to the function $f(x)=a(0)/2+a(1)*\cos(1*x)+a(2)*\cos(2*x)+\ldots+a(n)*\cos(n*x)+b(1)*\sin(1*x)+b(2)*\sin(2*x)+\ldots+b(n)*\sin(n*x)$;

progression of the start of the stroke H for automatic open loop control, and optional closed loop control, of the first "position" A using the measured values of the driving force transmission to the ram 2; and the run-out of the stroke H for automatic open loop control, and optional closed loop control, of the second "position" B of the separation of the driving force from the ram 2 using the measured values.

The working method and program can be designed such that, in the case of transfer presses in press lines, at least one transfer movement from one press to another for forming or cutting parts is controlled as a function of at least one of the following steps:

start of the stroke and monitoring of a first "position";

run-out of the stroke and monitoring of a second "position";

progression of the stroke and monitoring of a first path; and/or progression of the stroke and monitoring of a second path.

The method according to the invention for carrying out the working method can be implemented according to several variants:

1. A servo motor is provided in the region of a primary drive of the press for controlled running into the first position and controlled running out into the second position.
2. As an alternative, a coupling/brake combination may be provided for controlled running into the first position and controlled running out into the second position.
3. Moreover, it is possible to use a servo motor for controlled running into the first position and a coupling/brake combination for controlled running out into the second position.
4. Finally, the device may comprise a coupling/brake combination for controlled running into the first position and a servo motor for controlled running out into the second position.

The advantages that are obtained by achieving the object are that, as a result of the small ram strokes that can be implemented, the height of the presses, and notably the height of the "frames" of the presses, is reduced, and the drive trains, in terms of the design of the individual machine elements thereof, can be smaller and better optimized, whereby costs can be lowered, because the rotating and moving masses can likewise be reduced, whereby the entire (expensive) drive train can be made smaller.

As a result, a significantly smaller press can be implemented, which also lowers costs for building engineering.

The purely technical/functional advantage includes achieving sufficient and optimized freedom of motion, despite smaller ram strokes.

The invention thus achieves the object stated above in that, in the work process of the work steps and the means for operating forming presses or cutting presses of the type described above, while observing newly established physical boundaries:

smaller ram strokes having optimized freedom of motion of the press, rather than the existing large freedom of motion, are made possible;

the acceleration and speed of the ram are, at most maintained, or reduced, with increased parts output; and smaller paths are achieved due to dynamic ram stroke and transfer movements.

Moreover, the comparison according to FIG. 3 illustrates the potential for a higher stroke frequency, which is to say that this allows higher performance, such as quantities per unit of time in forming or cutting workpieces. This can notably be taken advantage of when the geometries of the parts allow for short residence time in the free travel of the ram stroke. In the most favorable case, the shortest ram stroke can even be performed substantially without standstill of the ram during part transfer.

The accordingly designed presses therefore constitute a new generation of presses with optimized output.

DETAILED DESCRIPTION OF THE INVENTION

Figure 1:
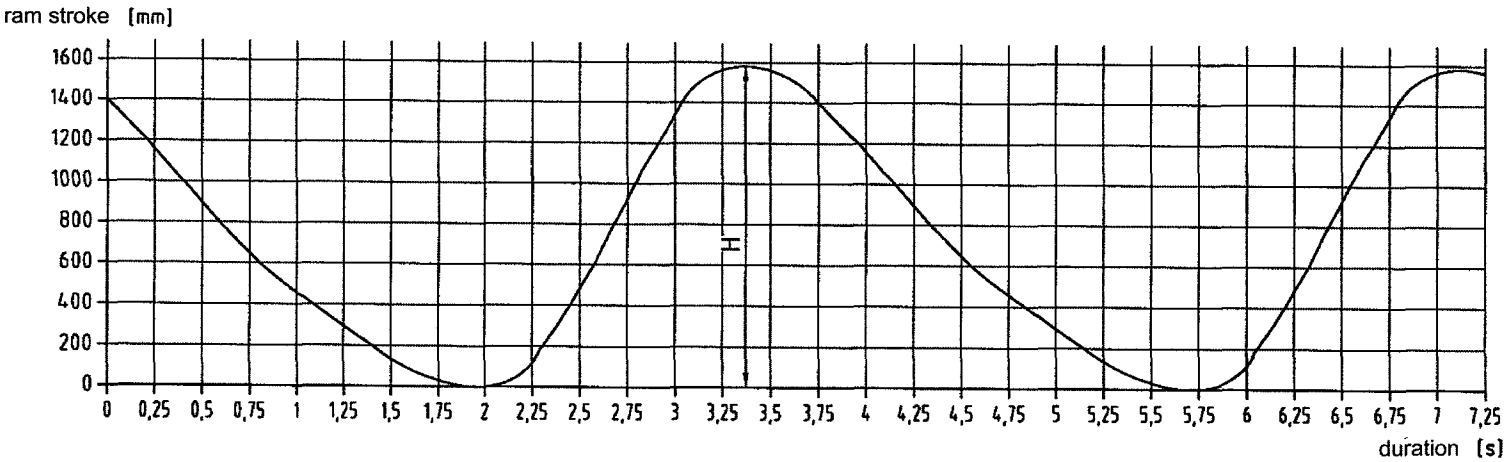
FIG. 1 is a graphical representation of a hypothetical ram curve as prior art, wherein a ram stroke of 1,590 mm, a line stroke rate of 16 strokes/minute, and a forming speed of 600 mm/s at 200 before UU are assumed.

Referencing the aforementioned FIG. 1, the same clearly shows how, in existing press processes, the progression of the press ram, tracked in the form of a diagram, with relatively long ram strokes of up to approximately 1,400 mm resulted in the technological and construction-related drawbacks described at the beginning.

Figure 2:
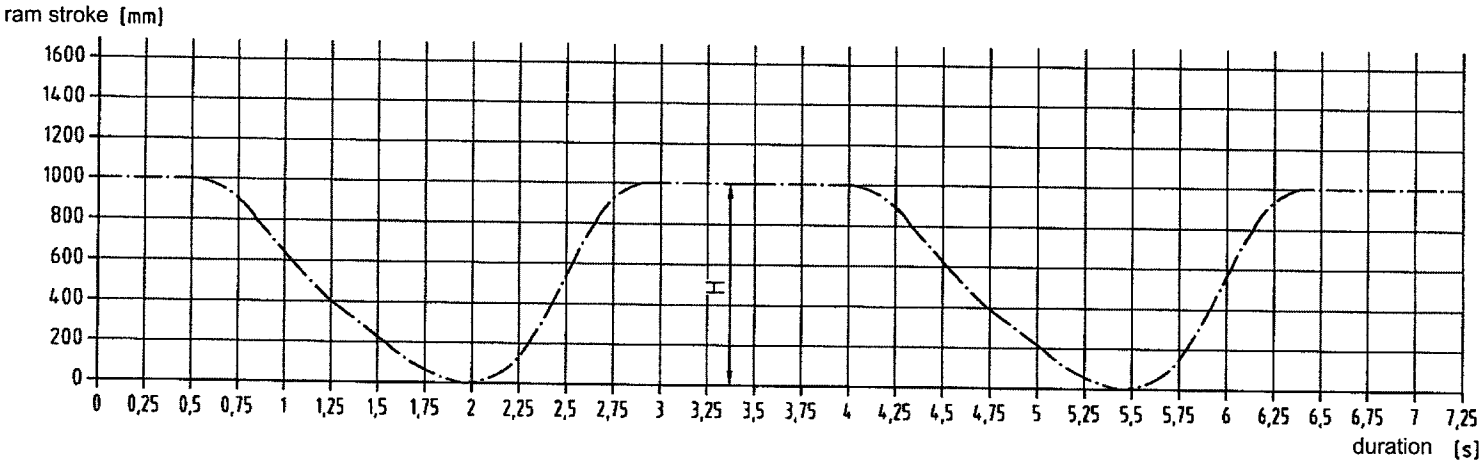
FIG. 2 is a graphical representation of a ram curve according to the invention wherein, in addition to the above comparable data, a ram stroke of 1000 mm and, in a cycled fashion, a press stroke rate of 24.7/ minute are specified.
Figure 3:
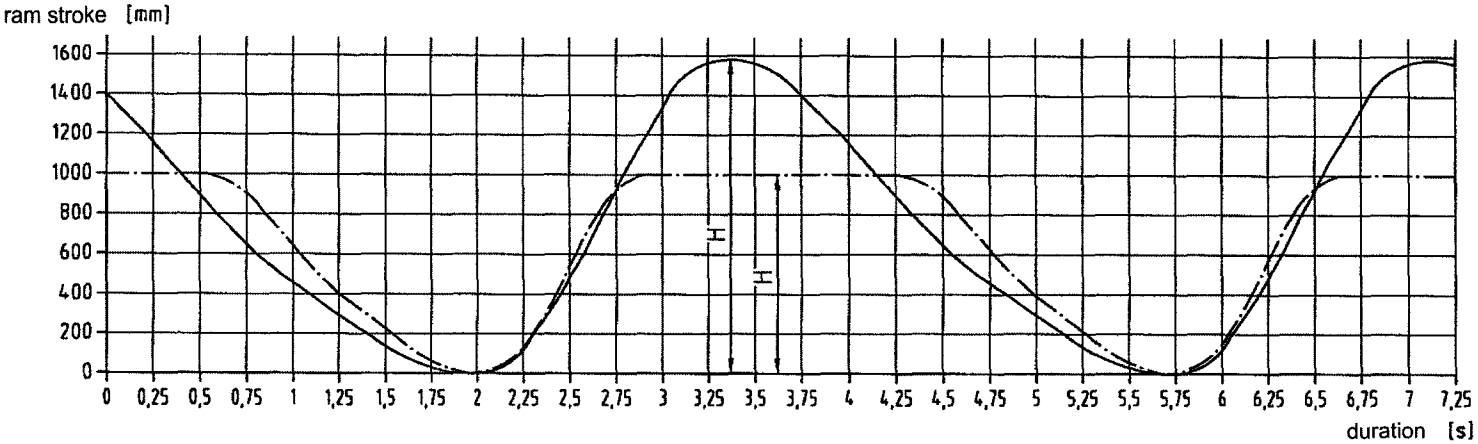
FIG. 3 is a graphical representation according to FIGS. 1 and 2, for the purpose of illustrating the effect of the existing ram curve compared to the ram curve according to the invention.

The graphical representation of a ram curve according to the invention shown in FIG. 2, in contrast, shows, using comparable performance data, that a ram stroke of approximately 1000 mm, in a cycled manner, with a press stroke rate of 24.7/ minute, can be realistically specified. As a result of the relatively small ram strokes implemented, the height of the presses, and more particularly the height of the "frames" of the presses 1, can be reduced, and the drive trains can be designed smaller, in terms of the individual machine elements thereof, and can be optimized, whereby costs are lowered. Likewise, the rotating and moving masses can be reduced, whereby the entire drive train can be smaller. The graphical representation according to FIG. 3 shows the two effects by comparing different ram curves.

Figure 4:
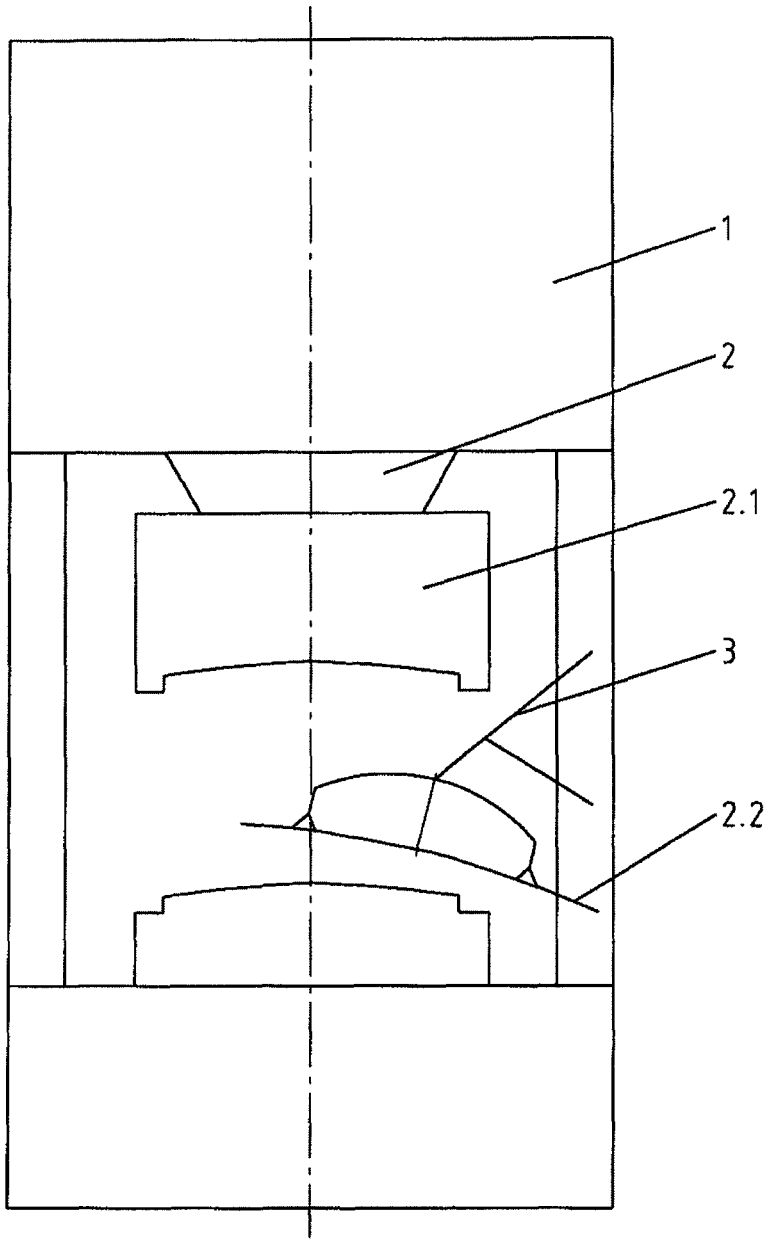
FIG. 4 is a schematic illustration of an arbitrary press (1) for carrying out the working method.
Figure 5:
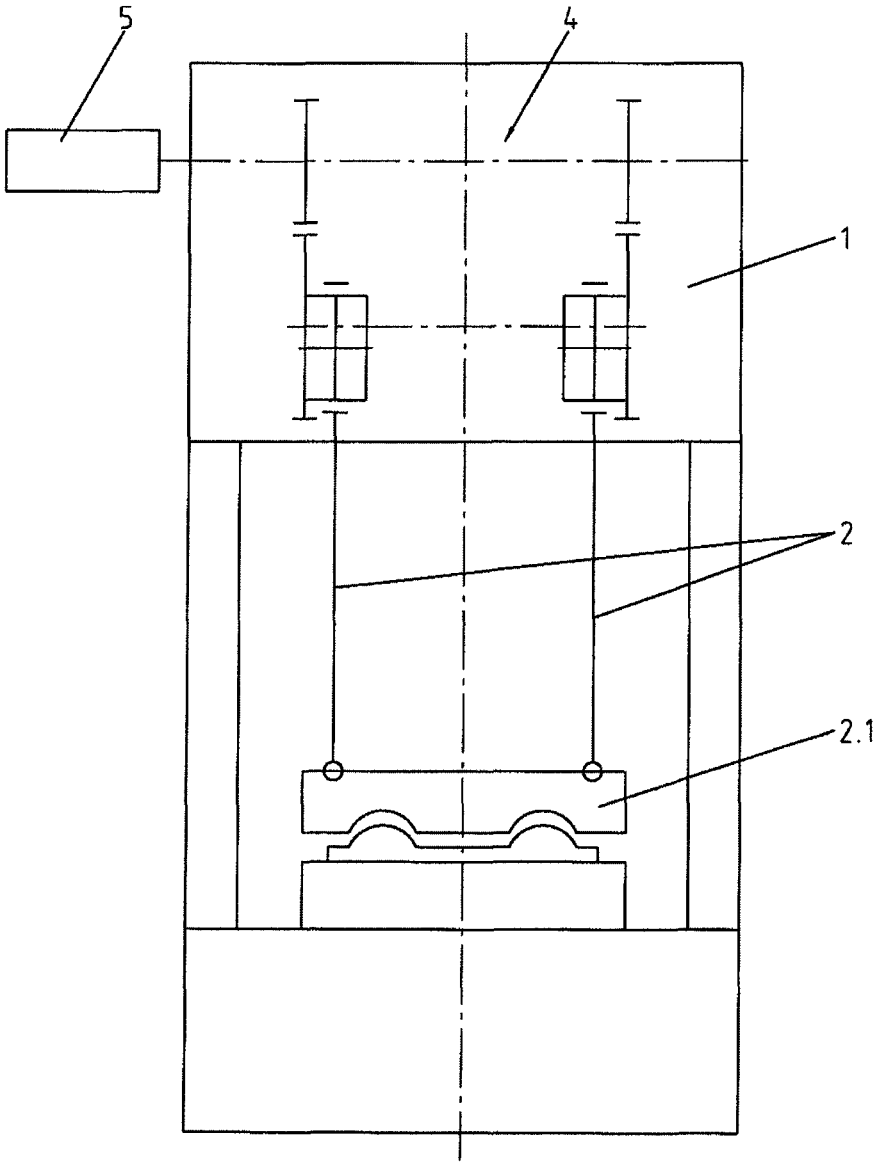
FIG. 5 is a schematic illustration of the press (1), comprising a servo motor (5) which brings about the run of the ram (2) into a first position (A) and a second position (B) according to FIG. 7 and which is arranged in the region of the primary drive (4) of the press (1)
Figure 6:
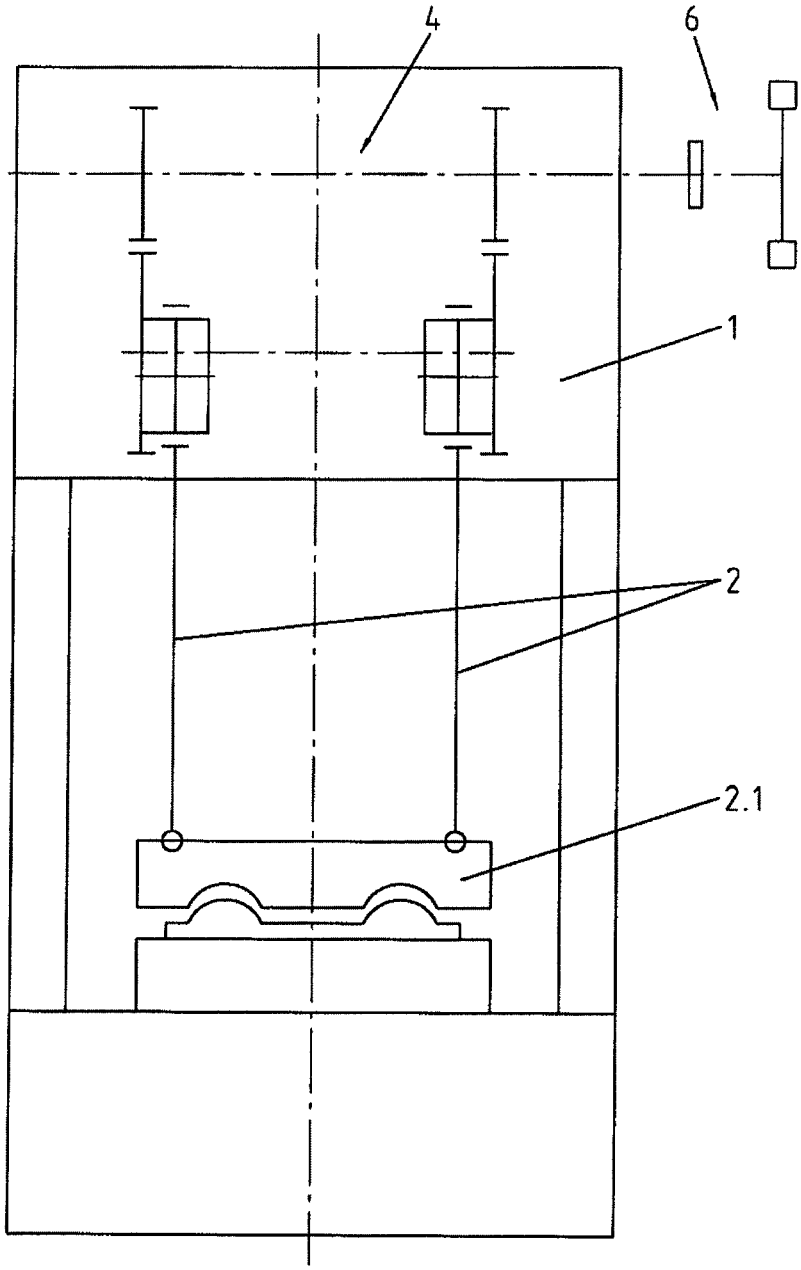
FIG. 6 is a schematic illustration of the press (1), comprising a coupling/brake combination (6) which brings about the run of the ram (2) into a first position (A) and a second position (B) according to FIG. 7 and which is associated with the primary drive (4) of the press (1)

FIGS. 1 to 3 and 7 show the respective height of a stroke H of a ram 2, which is shown schematically in FIGS. 4 to 6.

The method according to the invention for operating a press 1, shown schematically in FIGS. 4 to 6, comprising the aforementioned ram 2 and a die 2.1, can be used for forming presses or cutting presses. The method can thus be integrated without difficulty in forming presses, such as multiple-die presses for large workpieces, transfer presses, multi-ram transfer presses or cutting presses, including in press lines, which are not shown, for forming or cutting parts 2.2, essentially comprising the work steps of feeding, optionally centering, forming or cutting, and depositing the parts 2.2, with integrated transfer steps for the parts 2.2.

The cooperation of the steps according to the invention and corresponding means for the cycled strokes H for forming or cutting the parts 2.2 in the respective press 1 is now adjusted, in accordance with the working method according to the invention, by controlling the stroke H of the ram 2, for forming or cutting of the parts 2.2, so as to achieve smaller strokes H in relation to an optimized and sufficient freedom of motion of the press in accordance with the function f(x) =a(0)/2+a(1)*cos(1*x) +a(2)*cos(2*x) + ... +a(n)*cos(n*x) +b(1)*sin(1*x) +b(2)*sin(2*x) + ... +b ( n)*sin(n*x), more specifically while actively influencing at least one of the values of a stroke rate of the ram 2, position of the ram 2 defined in terms of time or path, driving force of the ram 2, speed or acceleration of the ram 2, minimum freedom of motion of the press 1 or transfer movement from one press 1 to another press 1.

To this end, values for the stroke H of the ram 2 can be specified in a cycled manner relative to, for example, a press stroke rate that is increased by 1.5. According to FIG. 7, at least one value, such as a first "position" A in the process of the stroke H over a time t is monitored, with transmission of the full driving force to the ram 2 being measured in this first "position" A.

It is advantageous in practice that this monitoring and control can also be carried out by tracking the position of the rotational angle on an associated rotating machine element.

The progression of the start of the stroke H is not only monitored, it can even be controlled within a first path $I_1$, so as to exactly maintain the time dependent or rotational angle dependent "position" A of the ram 2 in a reproducible manner.

Figure 7:
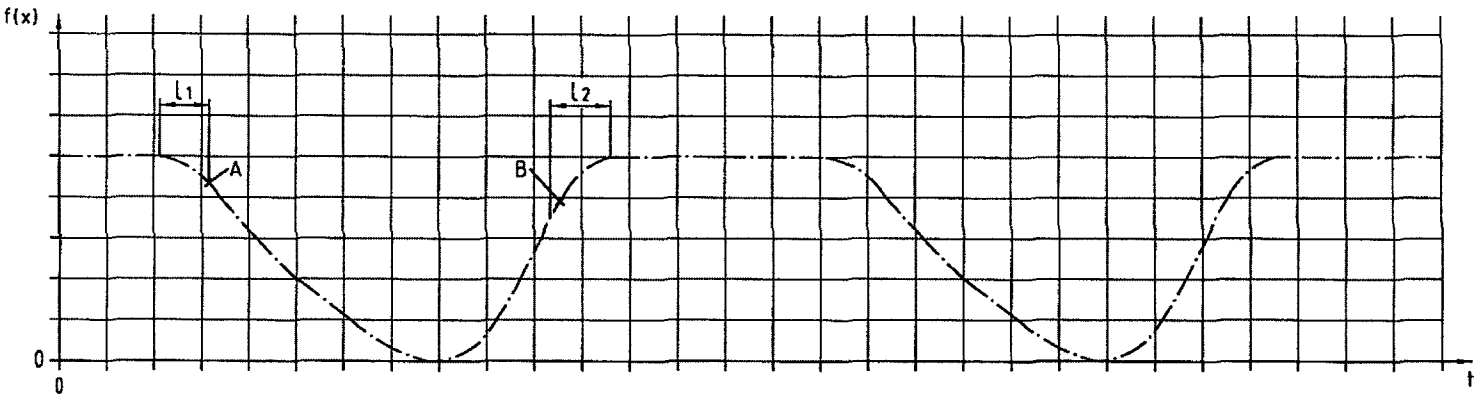
FIG. 7 is a graphical representation of monitoring and controlling of the process of the stroke (H) of the ram (2) in the first "position" (A) and of the stroke (H) of the ram (2) in the second "position" (B).

Moreover, the run-out of the stroke H is monitored and a second "position" B of a separation of the driving force from the ram 2 is measured, as is apparent from FIG. 7. Again, the run-out of the stroke H is not only monitored, but advantageously controlled within the range of a second path $I_2$, so as to also exactly maintain this "position" B of the ram 2 in a reproducible manner, and more specifically, similarly to the first "position" A, in a time dependent or rotational angle dependent manner.

A process of the method, which is shown in its entirety in FIG. 7, is thus apparent and optimized if:

control is carried out according to the function ... f(x)=a(0)/2+a(1)*cos(1*x) +a(2)*cos(2*x) + ... +a(n)*cos(n*x) +b(1)*sin(1*x) +b(2)*sin(2*x) + ... +b(n )*sin(n*x), values for the stroke H of the ram (2) being specified in a cycled manner relative to a press stroke rate (F) that is increased, for example, by 1.5;

progression of the start of the stroke H is monitored, controlled, and values, such as the first "position" A of the full driving force transmission to the ram 2, are measured; and run-out of the stroke H is monitored, controlled, and values, such as the second "position" B of the separation of the driving force from the ram 2, are measured.

As was already described above, a denotes the stroke H and x denotes values from 0 to 2* Pi, whereby, for the purposes of the invention, a specified variable is taken as a value which is used for control purposes during the work process of the ram stroke in sub-regions. In this way, a relatively small ram stroke is specified, in a cycled manner, for a press stroke rate, so that an optimized and sufficient freedom of motion of the press is achieved, instead of the existing large, over-dimensioned freedom of motion.

So as to be able to represent and specify any cyclical movement of the stroke according to the formula $$\text{Stroke}=a(0)/2+a(1)*\cos(1*x)+a(2)*\cos(2*x)+\ldots+b(1)*\sin(1*x)+b(2)*\sin(2*x)+\ldots,$$

where x ranges from 0 to 2* Pi, coefficients according to the example below can be found:

| i | a(i) | b(i) |
|---|---|---|
| 0 | 1354.227058823529000 | 0.000000000000000E+000 |
| 1 | 6.211087651786986E−014 | −6.243906782879537E−014 |
| 2 | 290.202318413831200 | −384.289975236601800 |
| 3 | −2.715830852687821E−013 | 1.884187204349276E−013 |
| 4 | 49.316050906761640 | 173.327940214515400 |
| 5 | −1.805616042677905E−013 | −5.744078144460588E−014 |
| 6 | −15.088290781260220 | −5.845234989164741 |
| 7 | −1.873716376516641E−013 | 8.198941002907585E−014 |
| 8 | −1.986870683489189 | 1.230218243448128 |
| 9 | −2.750407780154656E−013 | 8.918586271192693E−014 |
| 10 | −2.564296084347008E−001 | 2.767316189620829 |
| 11 | −2.059102420910321E−013 | 7.826053253200130E−014 |
| 12 | 1.046079698263193 | 9.536276480635638E−001 |
| 13 | 3.857297670670378E−014 | −1.600336005800794E−015 |
| 14 | −2.222227580962598E−001 | 4.154063286283567E−002 |
| 15 | −3.169264053413094E−013 | 1.529856614009839E−013 |

The accuracy of the cyclical movements of the ram 2 taking place according to the invention can thus be determined and adjusted using a number of coefficients, which are thus functionally defined.

The method can be efficiently carried out by using a program which comprises the aforementioned steps and values for automatically controlling the press 1.

The program, which comprises the aforementioned steps for automatically controlling the press 1, should comprise at least one of the program steps, such as:

values found according to the function f(x)=a(0)/2+a(1)*cos(1*x ) +a(2)*cos(2*x) + ... +a(n)*cos(n*x) +b(1)*sin(1*x) +b(2)*sin(2*x) + ... +b(n)*sin(n*x);

progression of the start of the stroke H for automatic open loop control, and optional closed loop control, of the first "position" A using the measured values of the driving force transmission to the ram 2; and run-out of the stroke H for automatic open loop control, and optionally closed loop control, of the second "position" B of the separation of the driving force from the ram 2 using the measured values.

The program can moreover comprise data to be adjusted for these steps or to be achieved, such as the speed and acceleration of the ram 2, and a minimum freedom of motion of the press 1, measured based on the height of the stroke H to be specified.

The method and program can control at least one working step of any cyclical movement of the ram (2) according to the formula Stroke =a(0)/2+a(1)*cos(1*x) +a(2)*cos(2*x) +b(1)* sin(1*x) +... +b (2)*sin(2*x) +... + and coefficients found based thereon.

Finally, the method and program can be designed such that, in the case of transfer presses in press lines, at least one transfer movement from one press to another for forming or cutting parts is controlled as a function of at least one of the following steps:

start of the stroke and monitoring of a first "position";

run-out of the stroke and monitoring of a second "position";

progression of the stroke and monitoring of a first path; and/or progression of the stroke and monitoring of a second path.

For the purposes of this embodiment and the corresponding technological processes, transfer movement steps can be both preceding and following.

A device required for carrying out the method is shown schematically but, given the simplicity thereof, sufficiently, in FIGS. 5 and 6. For a person skilled in the art, the operation according to the invention of the press 1, shown schematically in FIG. 4, comprising the ram 2 and die 2.1 is thus clearly and easily comprehensible. For the sake of completeness, FIG. 4 also shows means for a transfer system 2.3 for transporting the parts 2.2 that are formed or to be formed, or cut or to be cut, optionally via a centering system, which is not shown in detail.

According to FIG. 5, for example, the device comprises a servo motor 5 for controlled running of the ram 2 into the first position A, which is essential to the invention, and for controlled running out into the second position B, which is essential to the invention. This servo motor 5 may be disposed in the region of a primary drive 4 of the press 1, connected to the primary drive 4, or designed as the primary drive 4.

FIG. 6 shows, by way of example, that a coupling/brake combination 6 is arranged upstream or downstream of the primary drive 4, or integrated therein, for the respective controlled running into the position A and running out of position B.

For the purposes of the invention, means exercising similar effects are conceivable, which:

monitor the first "position" A during the process of the stroke H over a time t, or according to the rotational angle, the full driving force transmission to the ram 2 being measured in this "position" A and the progression of the start of the stroke H within the first path $I_1$ being controlled, so as to be able to exactly adhere to the time-dependent "position" A of the ram 2 in a reproducible manner; and during the run-out of the stroke H, similarly monitor the second "position" B of separation of the driving force from the ram 2, and measure and control it in the region of the second path $I_2$, so as to be able to exactly maintain this "position" B of the ram 2 in a reproducible manner.

The economic and technical-functional advantages that can be achieved by virtue of the invention assure cost-effective, technologically improved production of the presses of the type in question by the manufacturer, with an increased practical value for the operator. Moreover, the invention advantageously affects the layout of the buildings surrounding the machines of the type in question.

The invention claimed is:

1. A method for operating a press or a line of presses in which a workpiece is transferred from one press to another press, each press comprising a ram and a die, the method comprising controlling stroke of each ram according to a function f(x) =a(0)/2 +a(1)*cos(1*x) +a(2)*cos(2*x) +. . . + a(n)*cos(n*x) +b(1)*sin(1*x) +b(2)*sin(2*x) +. . . +b(n)* sin(n*x), thereby actively influencing at least one stroke rate of each ram, position of each ram defined in terms of time or path, driving force of each ram, speed or acceleration of each ram, minimum freedom of motion of each press, transfer movement from one press to another press so as to achieve smaller strokes together with an optimized and sufficient freedom of motion of each press.

2. The method of claim 1, further comprising setting each ram stroke rate of each press at a higher than conventional value whereby control of the stroke of each ram by the function of f(x) decreases the stroke.

3. The method of claim 1, further comprising measuring driving force of each ram at a first position of each ram spaced from a position of each ram at a start of a ram stroke whereby control of the ram stroke by the function f(x) decreases the stroke.

4. The method of claim 3, further comprising monitoring progression of each stroke from a start of the stroke thereby to assure that in each stroke the first position at which driving force of each ram is measured is the same.

5. The method of claim 4, further comprising monitoring a second position of each ram, the second position of each ram being a position of each ram at which driving force is not being applied to each ram, the second position being further from the position of each ram at the start of the stroke than the first position of each ram.

6. The method of claim 5, further comprising monitoring and controlling progression of each stroke from a start of the stroke thereby to assure that in each stroke the second position of each ram is the same.

7. The method of claim 4, further comprising monitoring and controlling the progression of each stroke within a first path.

8. The method of claim 6, further comprising monitoring and controlling the progression of each stroke within a first path and within a second path.

9. The method of claim 7, further comprising measuring the progression of each stroke as a function of time.

10. The method of claim 8, further comprising measuring the progression of each stroke as a function of time.

11. The method of claim 7, further comprising measuring the progression of each stroke as a function of a rotational angle of a component of each press.

12. The method of claim 8, further comprising measuring the progression of each stroke as a function of a rotational angle of a component of the press.

13. The method of claim 1, in which a workpiece is transferred from one press to another press, further comprising controlling at least one transfer movement from one press to another press as a function of at least one of the following:

monitoring a first position of the ram from the start of each ram stroke;

at which first position a driving force is being imported to the ram;

monitoring a second position of the ram at which second position, driving force is not being imported to the ram;

monitoring a first path of progression of each stroke;

monitoring a second path of progression of each stroke.

14. the method of claim 5, wherein progression of the ram stroke to the first and second position is controlled by controlling at least one servo motor or a combination of a coupling and a brake, wherein the servo motor is a primary drive of the press or is connected to a primary drive of the press or the coupling/brake combination is connected upstream or downstream of the primary drive or the servo motor is used for controlling progression of the ram stroke to one of the first position and the second position and the coupling/brake combination is used for controlling progression of the ram stroke to the other of the first position and the second position.

* * * * *